United States Patent [19]

Compton

[11] Patent Number: 4,856,103

[45] Date of Patent: Aug. 8, 1989

[54] LUMINAIRE WITH DIFFERENT ASYMMETRY ALONG TWO HORIZONTAL AXES

[75] Inventor: Wayne W. Compton, Chino Hills, Calif.

[73] Assignee: Kidde Consumer Durables Corporation, City of Industry, Calif.

[21] Appl. No.: 220,046

[22] Filed: Jun. 24, 1988

[51] Int. Cl.[4] ..... F21V 5/02

[52] U.S. Cl. ..... 362/340; 362/308; 362/329; 362/339

[58] Field of Search ..... 362/308, 310, 311, 329, 362/337, 339, 340, 363, 404, 327

[56] References Cited

U.S. PATENT DOCUMENTS

| | | | |
|---|---|---|---|
| 2,474,327 | 6/1949 | Rolph | 362/340 |
| 3,189,739 | 6/1965 | McPhail | 362/340 X |
| 4,611,266 | 9/1986 | Schwartz | 362/340 X |

*Primary Examiner*—Stephen F. Husar

*Attorney, Agent, or Firm*—Donald D. Mon

[57] ABSTRACT

A luminaire for use in parking garages having a vertical reference axis, a horizontal driving lane axis, and a horizontal parking stall axis. The resulting asymmetry is such that there is a substantially greater throw of light along the parking stall axis than along the driving lane axis, with improved lighting for parking purposes, and glare free lighting for the driving lane.

10 Claims, 3 Drawing Sheets

PARKING STALL
AXIS 19

85
DRIVING LANE
AXIS 18
10
82
81
41
41
86

LUMINAIRE WITH DIFFERENT ASYMMETRY ALONG TWO HORIZONTAL AXES

FIELD OF THE INVENTION

This invention relates to luminaires, and particularly to a luminaire which is especially suited for the interior illumination of parking structures.

BACKGROUND OF THE INVENTION

One consequence of urban growth is the need for parking structures. As the cost of land increases, single level parking lots at grade level become less affordable, and multiple-level parking garages become the rule. Expenses for this purpose are grudgingly allowed, and they have developed as minimal structures with little or no aesthetics. The ceiling clearances are low, often only 7 feet high, and obstructions by way of beams and columns further add to a feeling of oppressiveness. Adding to this the "Hollywood" concept of a parking structure where bad events occur in the shadows, many persons become uneasy when using these structures, especially at night.

Often, conventional industrial area, and street light fixtures are used to illuminate these structures. Because such fixtures are either very simplistic, or are designed for different applications, the consequence of their use is a structure which when illuminated has many shadows and dark regions. The place becomes something of a cave, and indeed lacks some features which whether they would make it a safer place or not, at least would make a person feel more secure and likelier to want to be there.

In addition, for safety's sake, it is better for the illumination means not to glare into the eyes of the driver. Such glare can reduce the sensitivity of the driver's eyes to persons or objects in the vehicle's path, and could lead to potentially dangerous circumstances. Where luminaires are used which are not properly cut off, such glare is regularly produced.

To complicate matters, a parking structure inherently involves two sets of requirements, whose objectives are quite different. Yet these ought to be met by a single luminaire to minimize expense and clutter.

A conventional parking structure includes a central driving lane from which parking stalls branch off, usually at an oblique angle, but sometimes at a right angle, on both sides of the driving lane. For the driving lane, the objectives are, or should be, to provide a brightly lighted path along the driving lane, without glare in the eyes of the driver. Thus a symmetrical illumination pattern along the driving lane is called for, together with a cutoff of light at an angle that is sufficiently low to keep direct rays out of the driver's eyes. Side illumination into the parking stalls is of lesser importance for this path.

For the parking stalls, the criteria are quite different. Here the concept of perception becomes significant. A woman approaching her car would like to look into its backseat and find it well-enough illuminated to see that it is safe. Also, there should be no more than minimal shadows around the front and sides of the car so the person is not fearful of what may be hidden at the front end of the car.

For the parking stalls, there is little interest in illumination along the driving lane, but there is much interest in illumination of the axes oblique to it. Thus, the extent of asymmetry in the direction of the driving lane and in the direction lateral to it should be quite different from one another.

In fact, downward illumination of the two regions not only requires asymmetry along a pair of obliquely related axes, but also in more than one horizontal plane. The control of a downwardly-directed pattern is a well-known objective in area and pattern lighting. For example, see Wayne W. Compton et al U.S. Pat. No. 4,041,306 wherein illumination of specific sidewalk areas, and cut off of glare light, are objectives. However, the use of luminaires of this general class, while very adequate to direct light onto the ground in a specific pattern, attend primarily to downward illumination of the type used to light sidewalks and parks. The more sophisticated luminaires of this class are also concerned with cut off to reduce glare and visual pollution by glare light. While they do these well, their design frustrates the general type of three dimensional space illumination which is also needed to meet the objectives of this invention.

In order to provide for a feeling of security, as well as to provide illumination which reduces shadows and dark places, there is also needed a generally upward illumination that does not glare at the drivers, and that reaches well beyond the limits of the downwardly beamed light.

Along the driving lane, a generally diffuse beam directed toward the ceiling is useful for this purpose. Along the parking stalls, a more clearly regulated beam is directed toward the farther end of the stalls, together with a substantial illumination of the ceiling. These provide a substantial "volumetric" illumination along the parking stalls by both light reflected from the ceiling, and directed light.

Because of space and expense limitations, these features must all be provided in one luminaire, and this invention accomplishes that objective.

BRIEF DESCRIPTION OF THE INVENTION

A luminaire according to this invention has a vertical reference axis, a horizontal driving lane axis, and a horizontal parking stall axis. This system defines the orientation of the luminaire in space. It will generally be mounted to the ceiling with the reference axis vertically aligned and the driving lane axis parallel to a lane along which a vehicle will be driven. The parking stall axis will extend away from the driving lane axis. The driving lane axis and the parking stall axis will usually be normal to one another, because the luminaire will then best fit the largest number of installations. However, if preferred, these axes can be disposed at a different angle, such as the angle which the parking stall makes with the driving lane if it is other than normal. This will rarely provide enough advantage to justify making the luminaire in different configurations for that purpose alone.

The luminaire has socket means for a conventional luminaire lamp, disposed on its central, vertical axis. It is encircled by a peripheral reflecting band having an upper edge and a lower edge. A transparent window closes the luminaire at the lower edge. Downward light from the lamp directly through the window illuminates a substantial, generally circular area beneath the luminaire.

The lower edge acts as a cut off for light reflected from the reflecting band. The band is gently curved so that the increased area of pavement illumination provided by the reflected light can be made more uniform. According to a preferred but optional feature of this invention, the reflecting surface of the band is pleated so the light is not reflected directly back through the arc tube of the lamp itself. Light reflected through the lamp causes increased heating of the lamp, and shortens its life.

The features described this far will produce a circular pattern with a cutoff, usually about 72 degrees up from the vertical, suitable for the driving lane. Asymmetry is provided through a transparent peripheral band above the reflecting band and also generally above the lamp itself, by direct or refracted transmission of light directly from the lamp, and also from a top reflector. The light emanating from the transparent band is derived from upwardly directed rays from the lamp. Therefore, it is useful for ceiling illumination, and is also amenable to being directed variably as respects the driving lane axis and the parking stall axis, so as to provide asymmetry respective to each of them without objectionable glare or wastage of light.

According to a preferred feature of the invention, the transparent band is provided with refractive prisms in areas where light is directed along the parking stall axis. This prismatic transmission enables a longer throw than the lower cutoff edge, and because it is directed away from the driving lane, it does not cause glare to the driver. It does, however, illuminate both the ceiling and the parking stalls.

According to yet another preferred feature of the invention, the top reflector includes both specular regions providing strong directionality to the light it reflects, toward the parking stalls, and diffusing regions which diffuse the light it reflects toward the driving lane, thereby to avoid glare to the driver, but still generally above the driver's eyes. This provides general illumination which is supplemented by light passing through the transparent portion without refracting prisms, to directly light the ceiling along the driving lane axis.

The resulting asymmetry is such that there is a substantially greater throw of light along the parking stall axis, than along the driving lane axis, with improved lighting for parking purposes, and glare-free lighting for the driving lane.

This invention will be fully understood from the following detailed description and the accompanying drawings, in which:

DETAILED DESCRIPTION OF THE INVENTION

Figure 1:
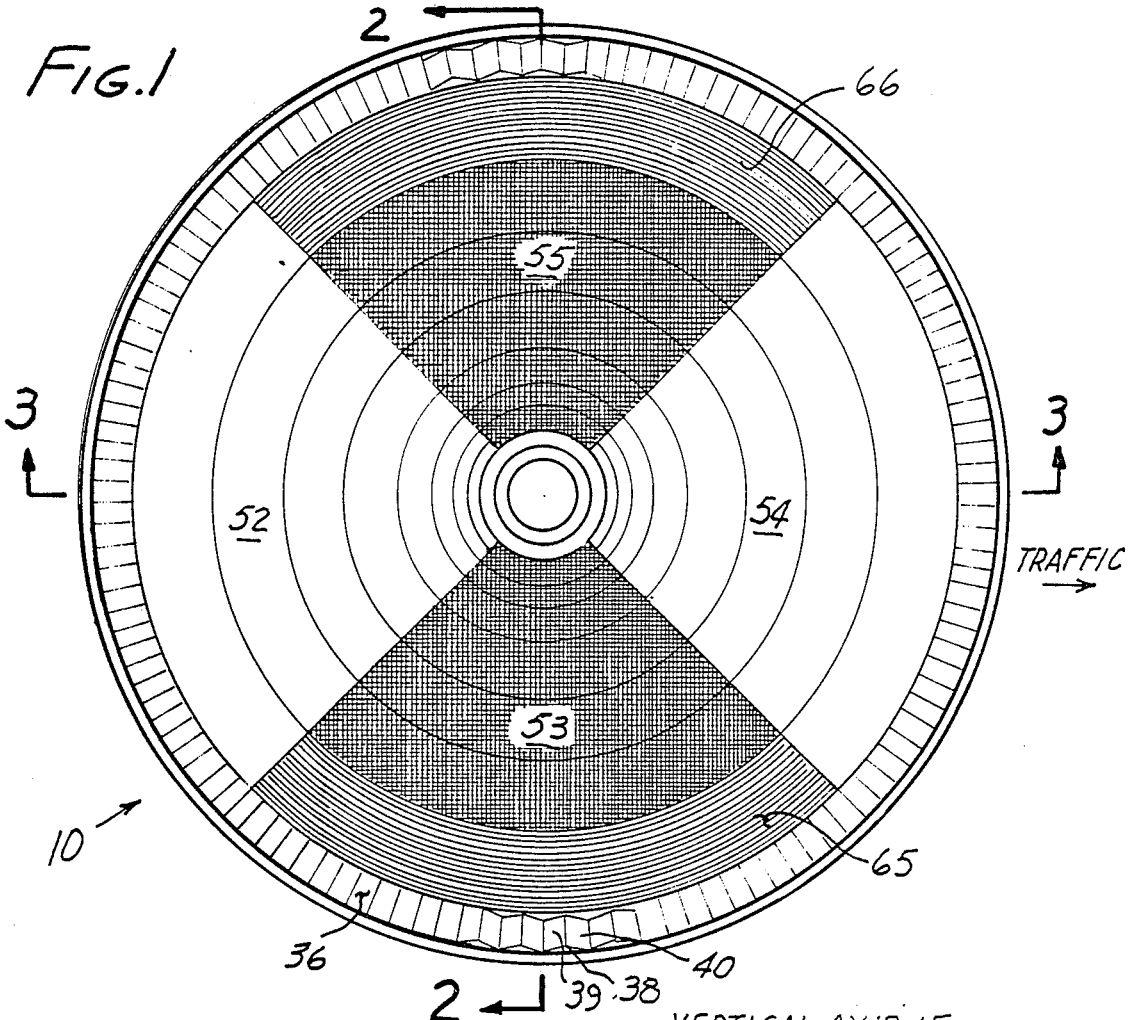
FIG. 1 is an upward view into the bottom of the luminaire.
Figure 2:
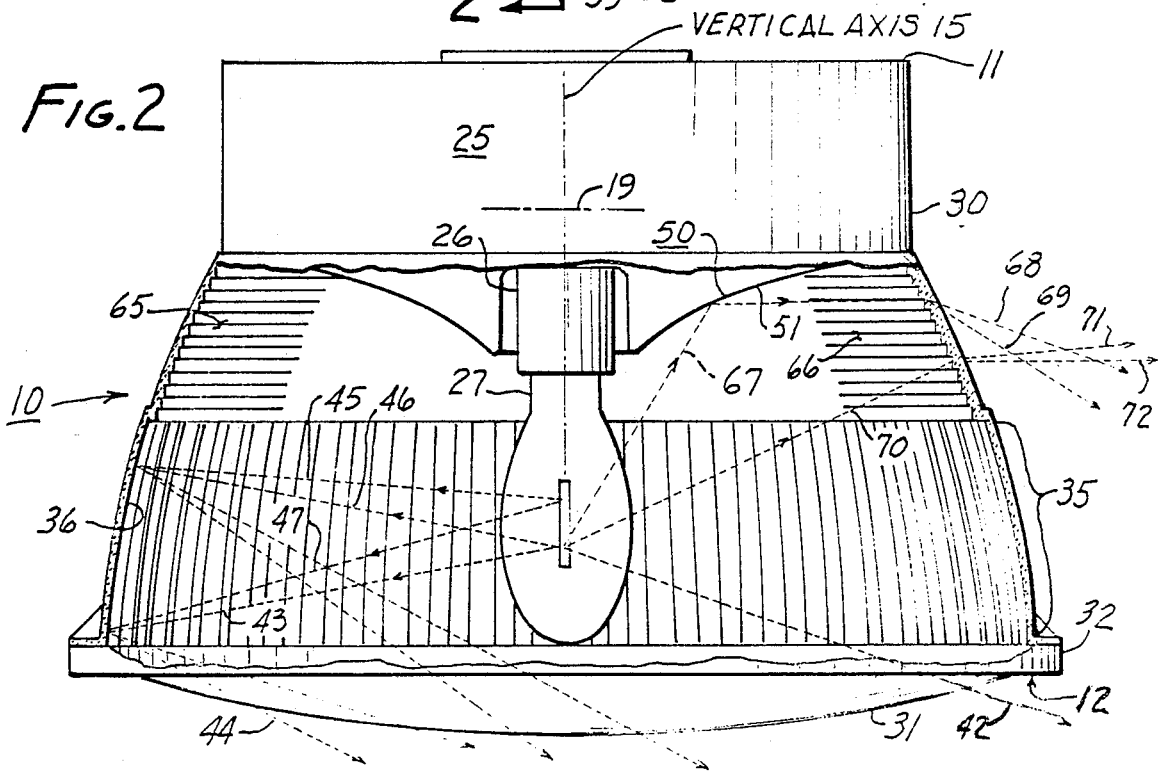
FIG. 2 is a cross-section, partially in schematic notation, taken at line 2—2 in FIG. 1, showing the parking stall provisions.
Figure 4:
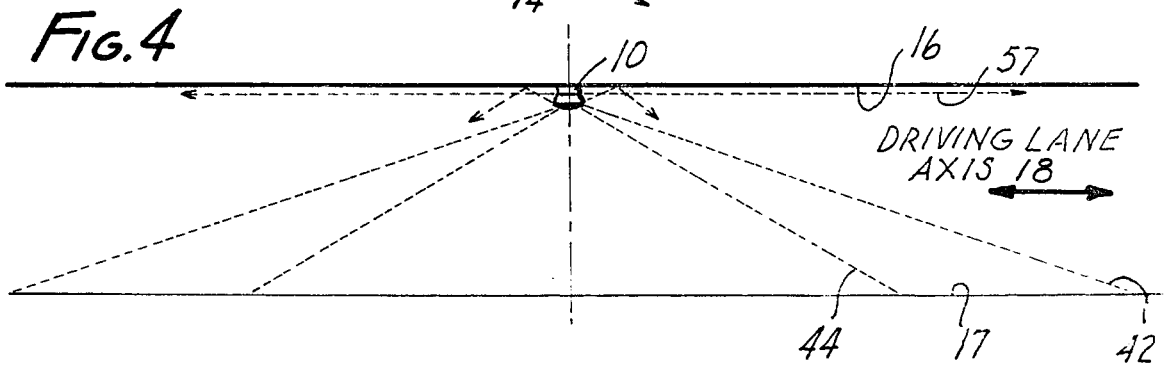
FIG. 4 is a schematic elevation taken along the driving lane axis.
Figure 5:
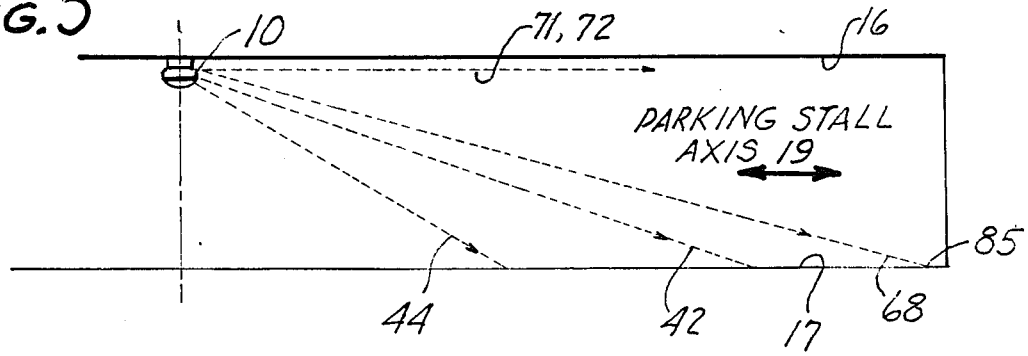
FIG. 5 is a schematic elevation taken along the parking stall axis.

The presently-preferred embodiment of a luminaire 10 according to this invention is shown in FIGS. 1 and 2. As shown in FIG. 1 it is a circular structure having an upper end 11 and a lower end 12. Because its pattern of emitted light is asymmetrical, three intersecting axes are required to define it. Vertical axis 15 is a central axis, and is denoted as vertical, because the emitted light pattern is defined relative to a horizontal ceiling 16 and horizontal pavements 17, as shown in FIGS. 4 and 5.

The luminaire is intended to provide its light pattern relative to a driving lane axis 18 and a parking stall axis 19. For convenience these axes are shown normal to one another, although it will be recognized that axes 18 and 19 could be disposed at some other non-parallel relationship if preferred. For example, the angle could be selected to conform to the angle which the parking stalls make with the driving lane if other than 90 degrees. Often this angle is 90 degrees, but very frequently it is a different angle instead.

It is not necessary that the parking stall axis of the luminaire coincide with the axis of the parking slots, although such a relationship is useful. Instead, for purposes of economical distribution and manufacture of the product, orthogonal relationships will usually be provided. Even when the parking stalls are not normal to the driving lanes, this relationship is very useful. Therefore the terms of definition are not limiting in the sense that the parking stall axis must be positioned so it is parallel to the stall.

The upper end of the luminaire comprises a base 25 with provisions (not shown) to mount it to supporting structures such as the ceiling or a supporting pendant or post, and includes electrical connection means to connect a socket 26 to a source of power. The socket receives a lamp 27 such as a high intensity sodium or mercury type, or even a conventional incandescent lamp. Although some lamps have arc tubes with substantial axial lengths along which light is emitted, for the purposes of this disclosure they will be generally treated as a point source. Persons skilled in the art will recognize the difference between the theoretical treatment of exemplary light rays and the actual emissions of a light source of substantial length and area.

The upper portion 30 of the base is opaque. Usually it will be a metal structure containing circuit interface elements. The body of the luminaire is hollow, and its lower end is closed by a transparent closure 31. The closure is held in place by a rim 32.

A peripheral reflecting band 35 extends around the central axis. It is not transparent, and has an inside surface 36 that is gently curved in vertical planes which include the central axis. Its range of elevation approximately conforms to the range of elevation of the active portions of the lamp. The inside surface 36 of band 35 is reflective and pleated along the vertical axis. Thus, as best shown in FIG. 1, it constitutes a series of bent dihedral angles such as angle 38 with reflecting faces 39, 40. The purpose of these faces is to reflect the light in such a way that it does not pass through the arc tube of the lamp. This greatly extends the life of the lamp and lowers its operating temperature. Because the reflected pattern from this arrangement is symmetrical, the emission from the luminaire is also symmetrical, as to these elements.

Figure 6:
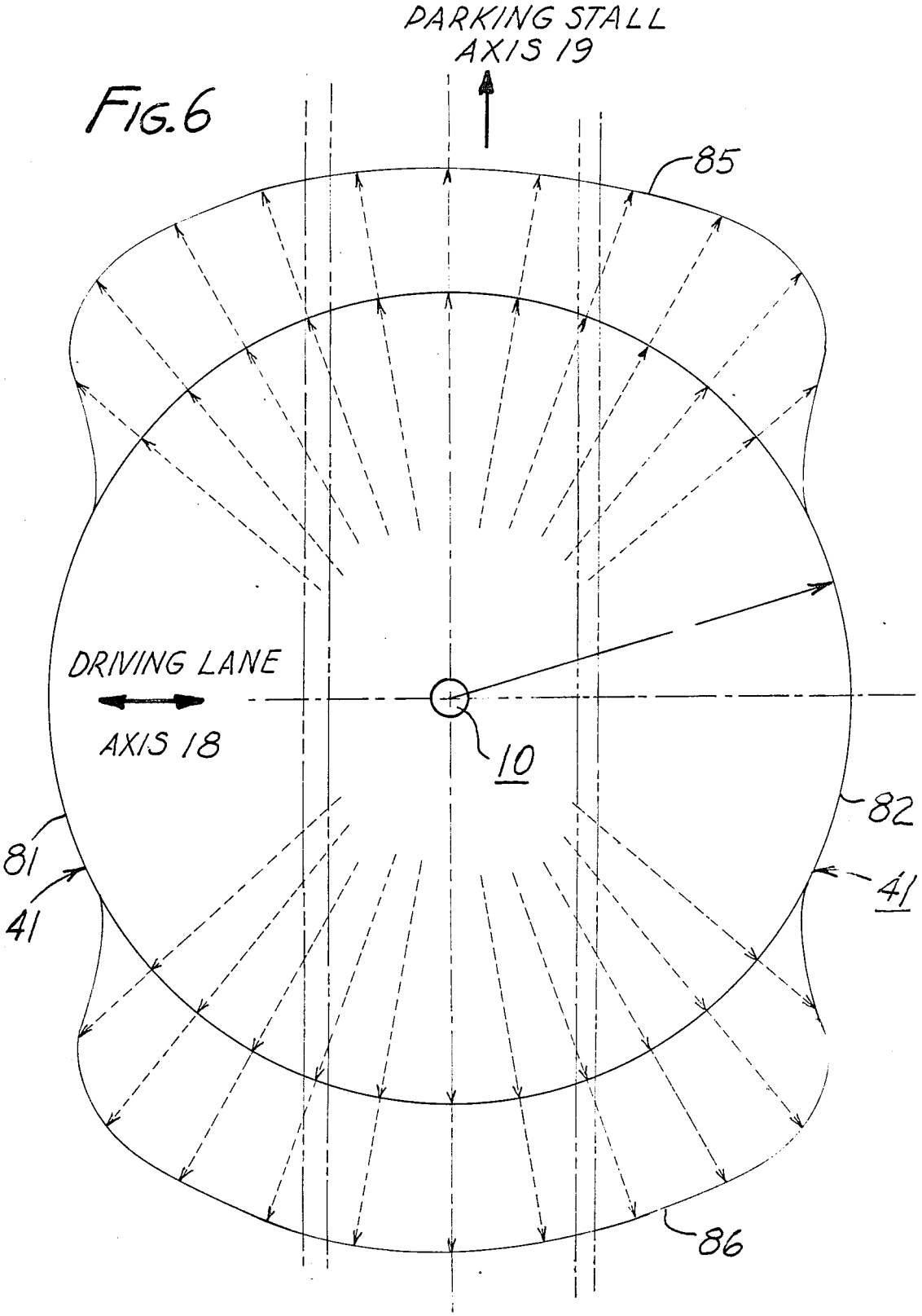
FIG. 6 is a schematic view of the luminaire's pattern, showing the asymmetry of the luminaire on the two horizontal axes.

Light reflected from the reflecting band is intended to light the pavement. These emissions are all symmetrical around the central axis. They combine with rays which pass directly from the lamp to the pavement, together to illuminate a circle 41 (FIG. 6).

The direct downward rays do not glare into the eyes of a driver. The reflecting band is so disposed and arranged that its reflected rays do not do so, either. For example, in FIG. 2, which shows rays on the parking stall axis, and in FIG. 3 which shows rays on the driving lane axis, see limiting ray 42 directly from the lamp, which along both axes grazes the lower, cutoff edge of the luminaire. Ray 42 is a limiting cutoff ray from the lamp and preferably makes an angle of about 72 degrees with the vertical.

Figure 3:
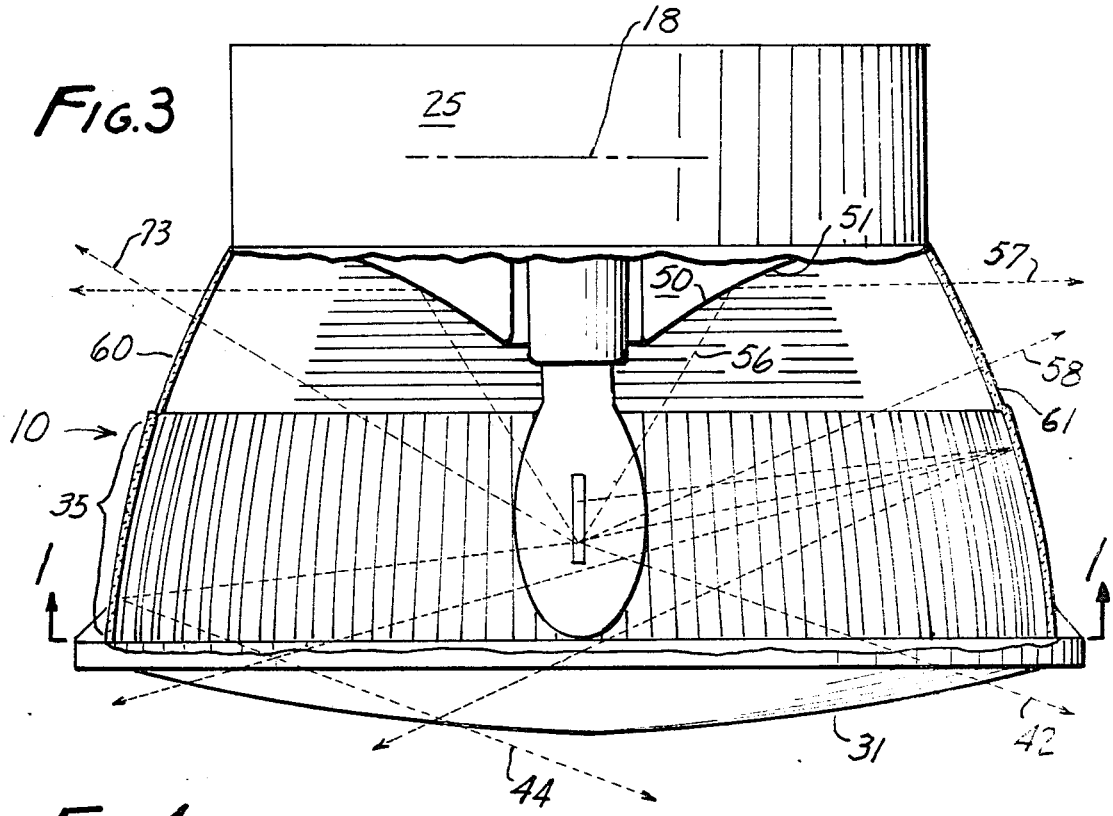
FIG. 3 is a cross-section, partially in schematic notation, taken at line 3—3 in FIG. 1, showing the driving lane provisions.

Rays 43 in both FIGS. 2 and 3 impinge on the reflecting band near its lower cutoff edge, and is reflected as limiting ray 44, less than about 72 degrees, but preferably near to it. As can be seen from an examination of exemplary rays 45, 46 and 47, all reflected rays within the limits of the lamp length and the height of the reflecting band, exit the luminaire at lesser angles to the vertical.

Thus, as to the driver no ray which exits the lower end of the luminaire is less favorable than ray 42. In a conventional structure with a relatively low ceiling, in which a conventional automobile is driven along the driving lane, the driver's eyes will be above the limiting rays 42, so there is no glare from the luminaire.

As to the parking stalls, and the light emitted from the lower end, there is no problem of glare, because the driver is always facing away from the luminaire. The various downwardly directed rays which pass out of the lower end of the luminaire in FIG. 2, which is a section along the parking stall axis, will be recognized as identical to those in FIG. 2. In this sense, the rays emitted downwardly are symetrical around the central axis.

The asymmetry of the invention therefore relates to the upwardly directed rays, which are prevented by the reflecting band from exiting at an angle above about 72 degrees. It is these upward rays which provide the asymmetry, and the singular advantages along both of the horizontal axes. These objectives are attained by a refractive effect on the parking stall axis, which is not provided on the driving lane axis.

As a further but optional feature, an upper element 50 can be provided with a different reflecting function for each of the two horizontal axes. Element 50 is a concave surface of revolution 51 with a geometric line generator rotated around the central axis. As best shown in FIG. 1, it is divided into four quadrants or sectors 52, 53, 54, 55. Quadrants 53 and 55 are specularly reflective. Quadrants 52 and 54 are diffusely reflective.

Quadrants 52 and 54, which are diffusely reflective, are related axially to the driving lane axis (see FIG. 3). Rays such as exemplary ray 56 impinge on these surfaces, and are generally reflected as a diffuse family of rays 57 at a rather high angle, generally greater than about 85 degrees, so as to provide illumination to the ceiling and adjacent beams and also general area illumination in the structure above the vehicles. Direct upward rays 58 from the lamp illuminate the ceiling.

All of these rays pass through respective transparent regions 60, 61 of the transparent band, formed by two generally parallel surfaces. Thus, along the driving lane axis the upper rays light the ceiling and the general volume, and are generally above the driver. In case they are not, the diffuse quality of quadrants 52 and 54 prevents the existence of a brilliant spot of light. Instead there is a diffuse, wide light source of considerably limited intensity. The inverse curvature of the quadrant surfaces further limits the generation of a brilliant spot.

The objectives for the parking stalls are quite different. These are to illuminate the stalls ahead of the parked vehicles and to provide downward light to illuminate the interior of the vehicles and fill in between vehicles. This is in addition to illuminating the ceiling and providing a good general volumetric lighting effect.

FIG. 2, which is an axial section along the parking stall axis, shows that specularly reflecting quadrants 53 and 55 reflect upwardly directed rays from the lamp which impinge on them generally laterally toward refractive regions 65, 66 on the peripheral transparent band above the reflecting band.

The refractive regions are formed by a sawtooth pattern on the inside surface, and over the vertical extent of rays which are reflected from the quadrants. Exemplary reflected rays 67 will be refracted as a family of rays 68, 69 which are downwardly directed, at an angle well above 72 degrees so as to be projected farther from the luminaire than the rays which are emitted from the bottom of the luminaire. As a consequence, there is a longer throw, as shown in FIG. 5. This tends to illuminate the top and hood of the vehicle, and the wall ahead of it, thereby reducing shadows in the region ahead of the vehicle.

In addition, upwardly directed light, exemplified by rays 70, impinge directly on the refractors. These are also refracted but exit as a family of rays 71, 72 at an elevated angle, but which will be projected farther away from the luminaire than if they had instead passed through a smooth transparent body. This light will illuminate the ceiling farther from the luminaire, and will be bounced back from the ceiling at the front end of the vehicle, additionally to illuminate that region, and further reduce the shadows between vehicles.

FIG. 3 shows that rays 73 can pass directly through smooth regions 60 and 61 nearer to the luminaire, where the ceiling illumination nearer the luminaire will improve the general illumination along the driving lane.

The consequence of the foregoing is best shown in FIG. 6, which schematically shows the total pattern of illumination viewed from above.

Circle 41 is the limit of the downward illumination along both axes. Along the driving lane axis, its segments 81, 82 represent the farthest throw caused by direct transmission and reflection, emitted from the bottom of the luminaire.

The upwardly transmitted rays through segments 60 and 61 are generally similiarly projected. The diffused rays from the diffused segments 52 and 54 are not shown, because they contribute to general illumination, rather than to a pattern.

The farther extent of projection of light along the parking stall axis is shown by line segments 85 and 86. This primarily shows the light which is refracted downwardly. Again the light projected or emitted at the ceiling and at the forward wall is ignored in this diagram, because it relates to general illumination. However, the refraction exemplified by rays 87 toward the ceiling is along the parking stall axis farther than the diffuse emmission along the driving lane axis.

Accordingly, the driving lane receives light from the bottom of the luminaire which is well-distributed and cut off to avoid glare. In addition, the ceiling is directly illuminated, and there is also a source of diffuse illumination—from the diffuse quadrants 52 and 54.

The parking stalls receive the same downward light from the bottom end of the luminaire. There is a longer throw of upper light downwardly, and a more intense illumination of the ceiling and front wall.

As a consequence, a single luminaire is provided which presents a well-lighted path to the driver, and a well-illuminated stall, both when unoccupied by a vehicle and when occupied by a vehicle. The general region is well-lighted, sufficient stray light is available to enable vehicles and pedestrians to be seen, and foreboding shadows are reduced or illuminated.

This luminate is readily constructed mostly from molded parts, and is compatible in appearance with the most artistic surroundings.

Its effective use of light can enable a reduced number of luminaires to be used. In a parking structure the pedestrian sees a gentle illumination with only minimal bright spots. The lighting effect is both efficient and agreeable.

This invention is not to be limited by the embodiments shown in the drawings and described in the description, which are given by way of example and not of limitation, but only in accordance with the scope of the appended claims.

I claim:

1. A luminaire having an upper end and a bottom end, a central vertical axis, a horizontal driving lane axis and a horizontal parking stall axis, the driving lane axis and the parking stall axis being normal to the vertical axis, and non-parallel to one another, said axes all intersecting one another, said luminaire comprising:

a base at said upper end including means for making electrical connections and means for supporting a lamp on said vertical axis;

a peripheral enclosure encircling said vertical axis, extending to an opening at said bottom end;

a transparent closure closing said opening;

a reflecting band formed on said enclosure extending from said bottom end to an elevation nearer to said base, and extending along said vertical axis, encircling the major portion of the axial length of said lamp in said socket, said reflecting band having a reflecting surface facing the vertical axis which curves in planes that include the vertical axis, the curvative being generally concave as it faces the vertical axis;

a transparent band above said reflecting band formed as part of said enclosure, said transparent band including transmitting regions on both sides of said enclosure which intersect said driving lane axis, said transmitting regions being smooth and continuous surfaces, said transparent band also including refracting regions on both sides of said enclosure which intersect said parking stall axis incorporating refracting elements which tend to deflect light downwardly which emitted upwardly from said lamp to impinge thereon, said transmitting and refracting regions alternating around the enclosure.

2. A luminaire according to claim 1 in which said reflecting band is pleated, whereby to deflect light from the lamp to a path which does not pass through the central portion of the lamp.

3. A luminaire according to claim 2 in which said pleated band comprises a succession of bent dihedral angles.

4. A luminaire according to claim 1 in which said refracting elements comprise saw tooth surfaces extending in a peripheral direction on said refracting band.

5. A luminaire according to claim 1 in which a top closure fits in said enclosure, being substantially a surface of revolution with a downwardly facing concave generator line, said surface of revolution being above said lamp, and in the path of at least some upwardly emitted light from said lamp, said top closure being generally aligned with said transparent band.

6. A luminaire according to claim 5 in which said top closure includes a pair of specularly reflecting sectors axially aligned with and facing toward said refracting regions, and a pair of diffusely reflecting sectors axially aligned with and facing toward said transmitting regions.

7. A luminaire according to claim 5 in which said reflecting band is pleated, whereby to deflect light from the lamp to a path which does not pass through the central portion of the lamp.

8. A luminaire according to claim 7 in which said pleated band comprises a succession of bent dihedral angles.

9. A luminaire according to claim 8 in which said refracting elements comprise saw tooth surfaces extending in a peripheral direction on said refracting band.

10. A luminaire according to claim 9 in which said top closure includes a pair of specularly reflecting sectors axially aligned with and facing toward said refracting regions, and a pair of diffusely reflecting sectors axially aligned with and facing toward said transmitting regions.

* * * * *